US005624254A

United States Patent [19]

Kee

[11] Patent Number: 5,624,254

[45] Date of Patent: Apr. 29, 1997

[54] CIGARETTE LIGHTER

[75] Inventor: Wong T. Kee, New Territories, Hong Kong

[73] Assignee: Capital Line Industries, Ltd., Hong Kong

[21] Appl. No.: 503,399

[22] Filed: Jul. 17, 1995

Related U.S. Application Data

[63] Continuation of Ser. No. 251,139, May 31, 1994, abandoned.

[51] Int. Cl.[6] ..... F23D 11/36

[52] U.S. Cl. ..... 431/153; 431/277

[58] Field of Search ..... 431/153, 277; 222/153

[56] References Cited

U.S. PATENT DOCUMENTS

| | | |
|---|---|---|
| 4,830,603 | 5/1989 | Cirami . |
| 4,921,420 | 5/1990 | Johnston . |
| 5,002,482 | 3/1991 | Fairbanks . |
| 5,074,781 | 12/1991 | Fujita . |
| 5,120,215 | 6/1992 | Amoros Nollas . |
| 5,165,886 | 11/1992 | Frigiere . |
| 5,215,458 | 6/1993 | Cirami . |
| 5,224,854 | 7/1993 | Ansquer . |
| 5,288,226 | 2/1994 | Khemarangsan . |

FOREIGN PATENT DOCUMENTS

| | | |
|---|---|---|
| 0291956 | 11/1988 | European Pat. Off. . |
| 0546373 | 6/1993 | European Pat. Off. . |
| 5-126333 | 5/1993 | Japan . |

*Primary Examiner*—Carl D. Price

*Attorney, Agent, or Firm*—Pollock, Vande Sande & Priddy

[57] ABSTRACT

A lighter comprising a gas receptacle for containing a compressed gas; a housing; a gas release means; an ignition means for igniting gas released by the gas release means from the gas receptacle; an actuation means for actuating the gas release means; and a safety mechanism having a locked position in which the safety mechanism prevents the actuating means from actuating the gas release means, and an unlocked position in which the safety mechanism allows the actuating means to actuate the gas release means; wherein the actuating means includes an actuating lever having an underside with a recess formed therein, a depression of which actuates the gas release means and wherein the safety mechanism comprises an outwardly extending locking arm when the safety mechanism is in the locked position abuts a nonrecessed portion of the underside of the lever and thereby prevents a depression of the actuating lever and thus preventing the actuation of the gas release means, but which, when the safety mechanism is in the unlocked position, is aligned with the recess in the underside of the actuating lever so that depression of the actuating lever and consequent actuation of the gas release means is made possible, and wherein the safety mechanism is retained in the unlocked position by a retaining portion of the safety mechanism abutting against a portion of the housing by the action of a biasing force.

5 Claims, 4 Drawing Sheets

CIGARETTE LIGHTER

This is a continuation of Ser. No. 08/251,139, filed on May 31, 1994, now abandoned.

BACKGROUND TO THE INVENTION

This invention relates to a lighter, and in particular, a hand-held lighter which has a safety mechanism.

A number of lighters have already been proposed, which are easy to operate, and thus have the disadvantage that a child can easily operate the lighter, and thus potentially start a fire or cause injury.

In U.S. Pat. Nos. 5,002,482 and 5,074,781, lighter arrangements are shown which have a safety mechanism. These designs, however, suffer from being complicated in design and therefore difficult and expensive to manufacture.

It is thus an object of the present invention to overcome the above disadvantage or at least to provide the public with a useful choice.

It is a further object of the present invention to provide a hand held lighter which is made less easy to operate by small children, but which is still easy to operate by adults.

It is a further object of the present invention to provide a hand held lighter of simple construction which will be simple and cost-effective to manufacture.

BRIEF SUMMARY OF THE INVENTION

Accordingly, the present invention broadly consists in a lighter comprising a gas receptacle for containing a compressed gas, a housing, a gas release means an ignition means for igniting gas released by the gas release means from the gas receptacle; an actuation means for actuating the gas release means; and a safety mechanism having a locked position in which the safety mechanism prevents the actuating means from actuating the gas release means, and an unlocked position in which the safety mechanism allows the actuating means to actuate the gas release means; wherein the actuating means includes an actuating lever, a downwards depression of which actuates the gas release means and wherein the safety mechanism comprises a locking arm which extends upwardly beneath the actuating lever and which when the safety mechanism is in the locked position prevents a downward depression of the actuating lever and thus prevents of the actuation of the gas release means, but which, when the safety mechanism is in the unlocked position is aligned with a recess in the underside of the actuating lever so that downward depression of the actuating lever and consequent actuation of the gas release means is made possible.

Preferably the safety mechanism is retained in the unlocked position by a retaining portion of the safety mechanism abutting a portion of the housing against the action of the biassing force and the safety mechanism returns to the locked position in reaction to the biassing force upon release of a downwards depression force applied to the actuating lever.

BRIEF DESCRIPTION OF THE DRAWINGS

Preferred embodiments of the invention will now be described by way of example with reference to the accompanying drawings in which.

DESCRIPTION OF THE PREFERRED EMBODIMENTS

Figure 1:
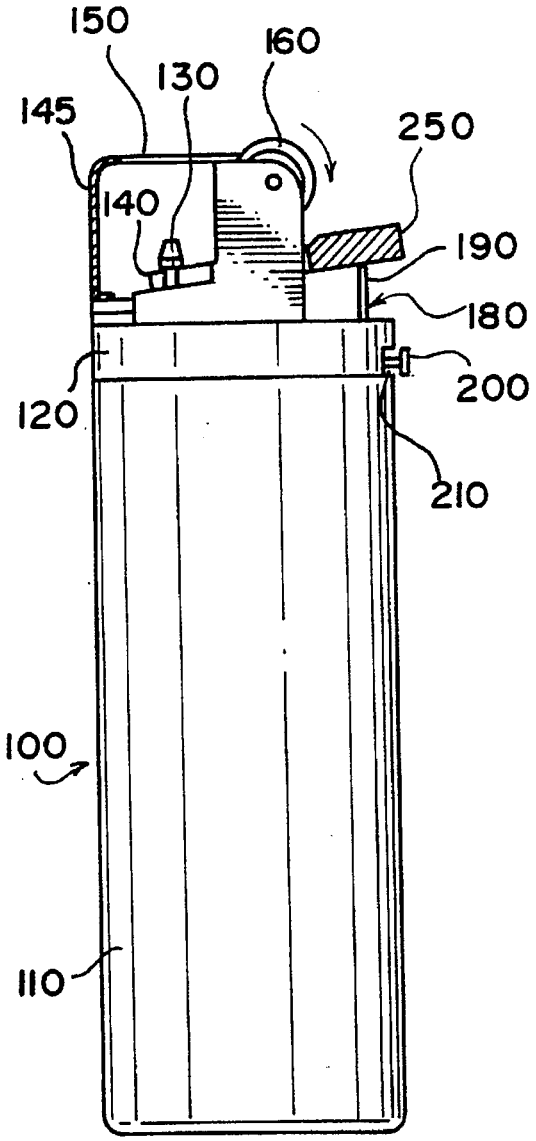
FIG. 1 shows a side view of a first preferred embodiment of a lighter in accordance with the invention with the windshield cover partly removed.
Figure 2:
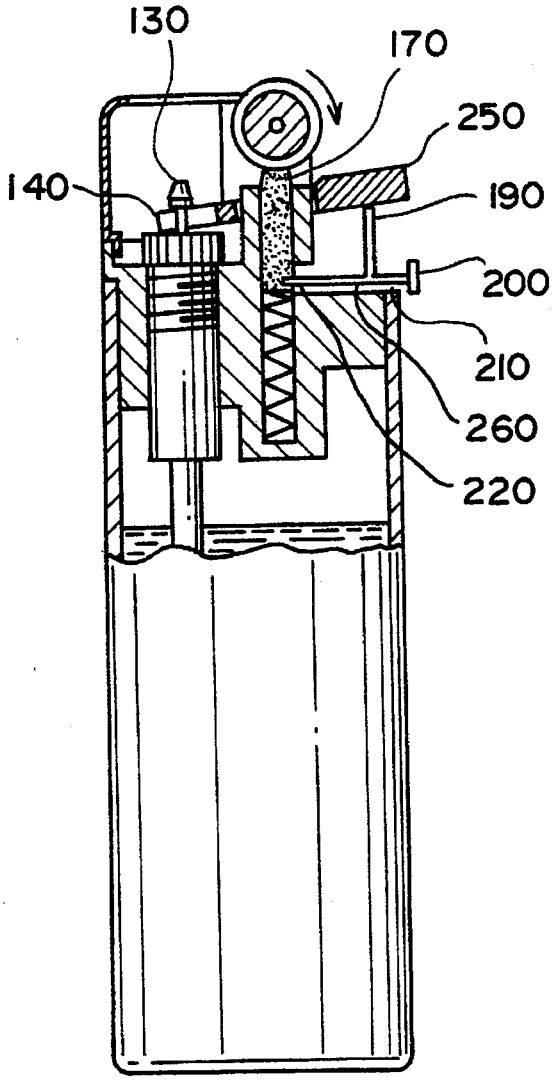
FIG. 2 shows a part cross-sectional side view of the lighter of FIG. 1.

Referring now in detail to the drawings, the figures show two embodiments of a lighter 100 of the invention, mostly of conventional design having a receptacle 110 in which compressed gas such as liquid petroleum gas may be stored. The gas may be released from receptacle 110 via valve 130, again of conventional type which is openable by a gas releasing means 140, which pushes up or down on the valve 130, as required, to release the gas. At substantially the same time as gas is released through valve 130 it is ignited by an ignition means which produces a spark by a rough surface of a rotatable ignition member 160 passing over a flint 170 at speed. As is conventional, the flint and valve are housed in a windshield 150 for safety and efficiency. The windshield member generally is provided with upstanding side walls 145; and further upstanding inner walls 155 (FIGS. 3 & 4), which inner walls 155 support the ignition member between the walls 145 as is conventional. A housing 120 fits over the top of the receptacle 110, and for stability a protrusion in the housing is received by a recess in the top of the receptacle 110. The gas releasing means is actuated by a lever 250, a downward depression of which will cause the gas releasing means to lift the valve 130 and release gas from receptacle 110. It will be understood that the lighter may have any suitable gas receptacle 110, gas valve 130, windshield 150, ignition means and gas releasing means as will be clear to those skilled in the art to which the invention relates.

In a first preferred embodiment, a conventional hand held lighter is modified as shown in FIGS. 1–4 to include a safety mechanism generally indicated at 180. The safety mechanism 180 fits in a recess 260 (FIGS. 3 & 4) in the housing 120.

Figure 3:
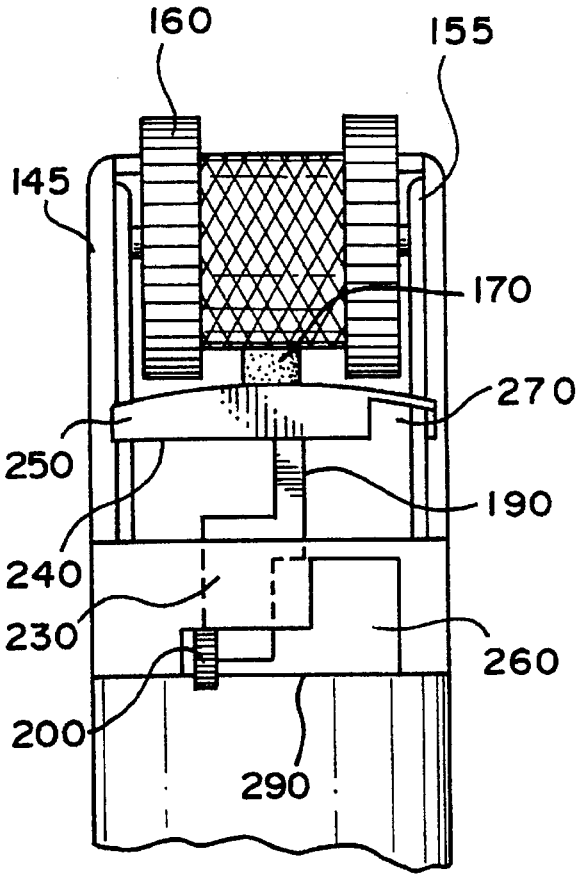
FIG. 3 shows a rear view of the lighter of FIG. 1 in a locked position.
Figure 4:
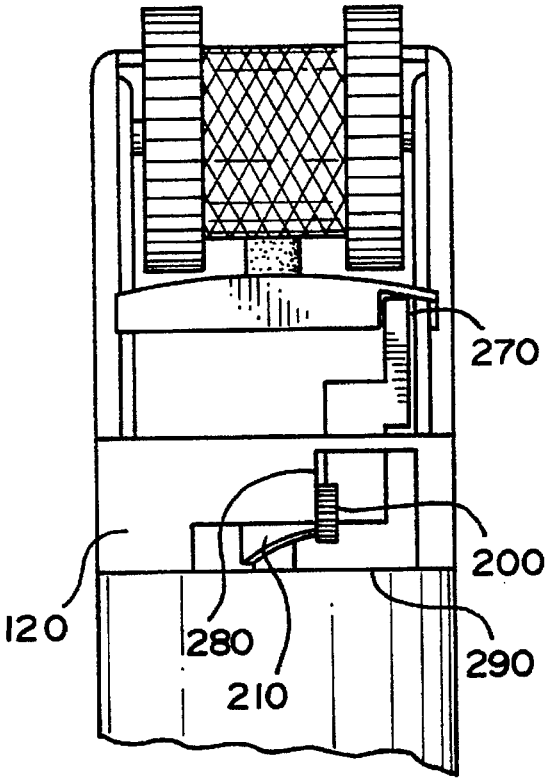
FIG. 4 shows a rear view of the lighter of FIG. 1 in an unlocked position.
Figure 5:
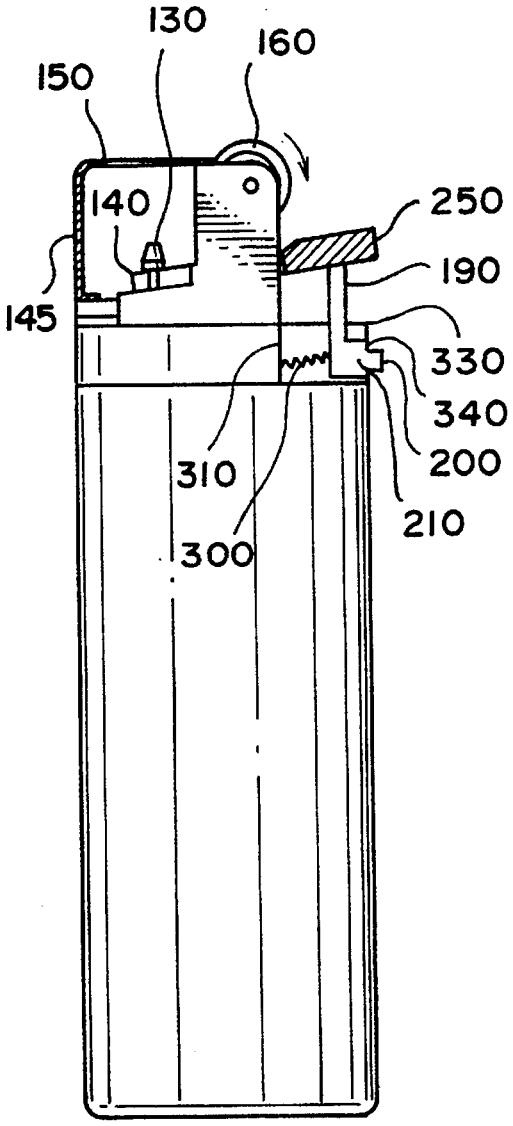
FIG. 5 shows a side view of a second preferred embodiment of a lighter in accordance with the invention with the windshield cover party removed.

The safety mechanism 180 comprises a base 210 which is secured to an inner portion of the housing 120. The base may be made of a resilient material, or it may be attached to the housing by a spring such as a leaf spring. Extending upwardly from the base 210 is a locking arm 190, one suitable configuration of which is shown in FIGS. 3 and 4. Extending outwardly from the base 210 is a positioning member 200, which is preferably ribbed or roughened, to aid a user in positioning the safety mechanism 180.

The locking arm may extend upwardly directly from the base 210, or alternatively, as shown in FIGS. 3 and 4, it may be displaced by a support member 230 for strength.

The safety mechanism 180 has two positions, a locked position (FIG. 3) and an unlocked position (FIG. 4).

When the safety mechanism is in the locked position (FIG. 3) downward depression of lever 250 is prevented by locking arm 190 abutting the underside 240 of lever 250. The base 210 is flush against the base 290 of the recess. To unlock the safety mechanism, the base 210 is moved, by moving the positioning member 200, in a lateral direction. This causes the locking arm 190 to also move in a lateral direction to be aligned with a recess 270 in the underside 240 of lever 250. The base 210 is then moved upwardly by positioning member 200 so that base 210 abuts against surface 280 of housing 120. If the safety mechanism 180 were secured in this position, downward depression of lever 250 would still be prevented. However, as the positioning member is now a small distance from the base 290 of recess 260, the lever 250 can be depressed downwardly an equal distance. Downward depression of the lever 250 now results in the activation of the gas release means and, if effected immediately after creating a spark, will result in ignition of the gas.

When the lever 250 is depressed the safety mechanism 180 is pushed down so that base 210 is again flush with the base 290 of recess 260. When the depression force on the lever is released, the safety mechanism, under force of the spring or resilience of base 210, returns to the position shown in FIG. 3.

In a second preferred embodiment, a conventional lighter is modified as shown in FIGS. 5–8 to include the safety mechanism 180. The safety mechanism 180 fits in a recess 260 (FIGS. 7 & 8) in the housing 120. A spring 300 is disposed between the safety mechanism 180 and a wall 310 in the recess 260. The safety mechanism's lateral movement is restricted by walls 320 of recess 260. A shelf 330 in the housing 120 limits the upward movement of the safety mechanism 180.

Figure 7:
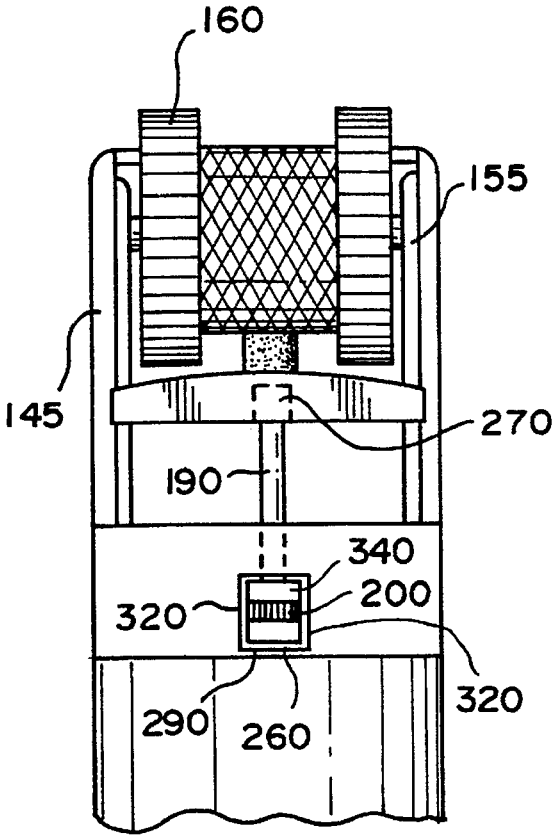
FIG. 7 shows a rear view of the lighter of FIG. 5 in a locked position.

In the locked position shown in FIG. 7, the safety mechanism 180 has a locking arm 190 extending upwardly from a base 210 and positioning member 200 of the safety mechanism, protrudes from the housing 120

The locking arm 190 abuts against shelf 330 under force of spring 300, and downward depression of the lever is 250 is prevented by locking arm 190 abutting the underside 240 of lever 250.

To unlock the safety mechanism, the safety mechanism is first moved into the housing by a user pushing the positioning member 200 towards the wall 310 against the force of spring 300. The safety mechanism 180 is pushed back a distance sufficient to disengage locking arm 190 from the shelf 330 and to align wall 340 of the safety mechanism 180 with shelf 330.

The user then exerts an upwards force on positioning member 200 to pivot the safety mechanism 180 about point 350, and to position wall 340 against shelf 330.

Figure 6:
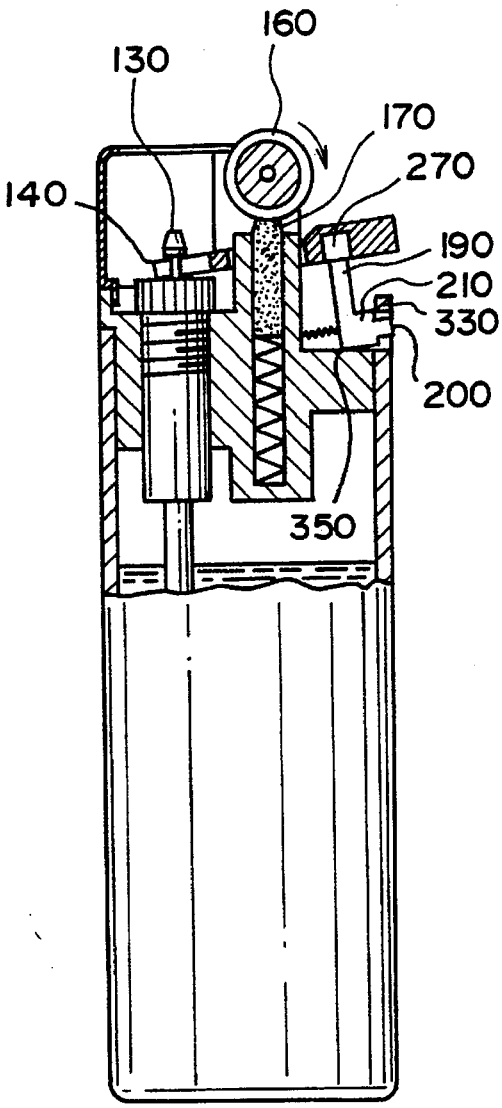
FIG. 6 shows a part cross-sectional side view of the lighter of FIG. 5.
Figure 8:
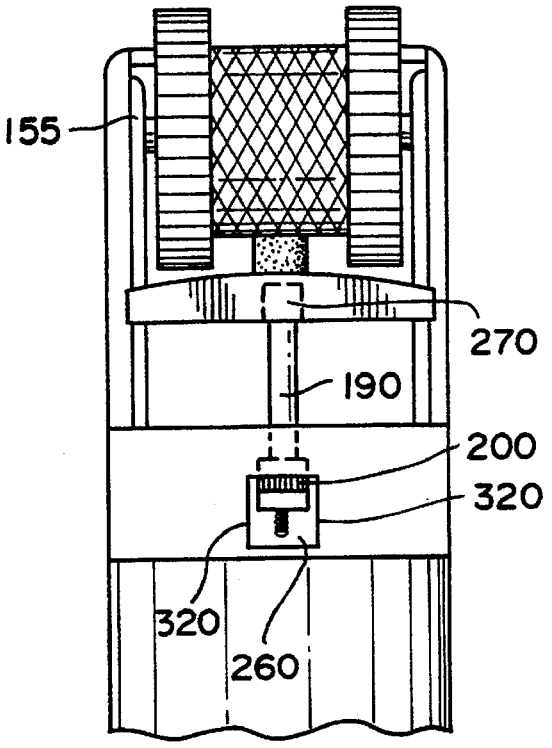
FIG. 8 shows a rear view of the lighter of FIG. 5 in an unlocked position.

The locking arm 190 is received by a recess 270 in the underside 240 of lever 250 and the safety mechanism is now in the unlocked position (FIGS. 6 & 8). The safety mechanism is retained in this position by spring 300 acting to press the wall 340 against shelf 330. The lever 250 is now capable of a downward movement sufficient to actuate the gas releasing means to open valve 130. The downward force on the lever 250 causes the safety mechanism 180 to pivot a little so that wall 340 and shelf 330 are no longer abutting each other. A release of the downward force on lever 250 causes the safety mechanism 180 to return to the position shown in FIGS. 5 and 7 under the force of the spring 300.

The above describes a preferred embodiment of the invention, variations and modifications in which may be made without departing from the scope of the invention as defined in the accompanying claims.

For example the biassing member need not be a spring, but may be any sufficiently resilient member or material. In the first embodiment, the safety mechanism may be slidable in the housing rather than moveable about a fixed point, or it may be hinged. In these cases a spring between the safety mechanism and a side wall of the recess would be required.

In the lighter of the invention the locking arms could be of any suitable configuration which prevents a downward depression of the lever in the locked position, but which is received by a recess in the lever in the unlocked position so as to allow such a downward depression of the lever. Similarly, the recess may be of any suitable configuration providing it can receive the locking arm. It is preferably wholly beneath the lever for aesthetic reasons and to avoid the locking arm slipping out of the recess.

I claim:

1. A lighter comprising a gas receptacle for containing a compressed gas; a housing; a gas release means; an ignition means for igniting gas released by said gas release means from said gas receptacle; an actuating means for actuating said gas release means; and a safety mechanism movable relative to said housing between an outer locked position in which said safety mechanism prevents said actuating means from actuating said gas release means, and an inner unlocked position in which said safety mechanism allows said actuating means to actuate said gas release means; wherein said actuating means includes an actuating lever having an underside with a recess formed therein such that downward movement of said actuating lever actuates said gas release means; wherein said safety mechanism comprises a substantially upwardly extending locking arm which, when said safety mechanism is in said locked position, abuts a non-recessed portion of said underside of said actuating lever and thereby prevents downward movement of said actuating lever, thus preventing actuation of said gas release means, but which when said safety mechanism is in said unlocked position, is aligned with said recess in said underside of said actuating lever so that downward movement of said actuating lever and consequent actuation of said gas release means are made possible; wherein said safety mechanism comprises an upper step portion and a lower step portion; wherein said upper step portion abuts against an underside surface of a shelf of said housing and a portion of said locking arm abuts against an inner side surface of said shelf when said safety mechanism is in said locked position; wherein said lower step portion abuts against the underside surface of said shelf when said safety mechanism is in said unlocked position wherein said safety mechanism is biased towards said locked position by a biasing action of a spring; wherein said safety mechanism is releasably held in said unlocked position by a portion thereof which is between said upper step portion and said lower step portion and abuts against the inner side surface of said shelf in response to said biasing action of said spring; and wherein said safety mechanism returns to said locked position in response to said biasing action of said spring upon release of a downward depression force being applied to said actuating lever.

2. A lighter as claimed in claim 1, wherein said spring is disposed substantially horizontally in said housing.

3. A lighter as claimed in claim 1, wherein said safety mechanism further comprises a positioning member extending outwardly from said housing for moving said safety mechanism between said locked position and said unlocked position.

4. A lighter as claimed in claim 1, wherein said safety mechanism further comprises a base extending away from said ignition means and said gas release means, and wherein said locking arm extends substantially upwardly from said base toward said underside of said actuating lever.

5. A lighter as claimed in claim 1, wherein when said actuating lever is downwardly moved while said safety mechanism is in said unlocked position, said locking arm is received by said recess in said underside of said actuating lever.

* * * * *